US011661685B2

(12) United States Patent
Budillon et al.

(10) Patent No.: US 11,661,685 B2
(45) Date of Patent: May 30, 2023

(54) HIGH SPEED BRAIDING MACHINE WITH MAGNETIC IMPELLERS

(71) Applicant: Admedes GmbH, Pforzheim (DE)

(72) Inventors: Florent Budillon, Pforzheim (DE); Kevin Lehmann, Pforzheim (DE); Marc O. Braeuner, Pforzheim (DE)

(73) Assignee: Admedes GmbH

( * ) Notice: Subject to any disclaimer, the term of this patent is extended or adjusted under 35 U.S.C. 154(b) by 318 days.

(21) Appl. No.: 15/872,030

(22) Filed: Jan. 16, 2018

(65) Prior Publication Data

US 2018/0202085 A1 Jul. 19, 2018

(30) Foreign Application Priority Data

Jan. 19, 2017 (DE) ..... 10 2017 000 467.6

(51) Int. Cl.

| | |
|---|---|
| ***D04C 3/06*** | (2006.01) |
| ***D04C 3/24*** | (2006.01) |
| ***D04C 3/20*** | (2006.01) |
| ***D04C 3/38*** | (2006.01) |

(52) U.S. Cl.

CPC ..... *D04C 3/06* (2013.01); *D04C 3/20* (2013.01); *D04C 3/24* (2013.01); *D04C 3/38* (2013.01)

(58) Field of Classification Search

CPC ... D04C 3/20; D04C 3/24; D04C 3/06; D04C 3/38

USPC ..... 87/40

See application file for complete search history.

(56) References Cited

U.S. PATENT DOCUMENTS

| | | | | | |
|---|---|---|---|---|---|
| 681,998 | A * | 9/1901 | Swift | D04C 3/38 | 87/18 |
| 1,103,181 | A * | 7/1914 | Elliot | D04C 3/00 | 87/51 |
| 2,238,644 | A * | 4/1941 | Hodges | D04C 3/00 | 87/44 |
| 2,817,206 | A * | 12/1957 | Schwartz | B21D 53/50 | 57/1 R |
| 3,088,363 | A * | 5/1963 | Sparks | B21F 99/00 | 87/33 |
| 3,290,984 | A * | 12/1966 | Nolan | D04C 3/00 | 87/51 |
| 4,615,256 | A * | 10/1986 | Fukuta | D04C 3/40 | 87/37 |
| 2012/0012620 | A1* | 1/2012 | Mejia | D04C 3/00 | 223/35 |
| 2015/0218739 | A1* | 8/2015 | Gessler | D04C 3/08 | 87/50 |

(Continued)

FOREIGN PATENT DOCUMENTS

| | | | |
|---|---|---|---|
| DE | 4201413 | A1 | 7/1993 |
| DE | 102011012166 | A1 | 8/2012 |
| DE | 102012205906 | A1 | 10/2013 |

(Continued)

*Primary Examiner* — Khoa D Huynh
*Assistant Examiner* — Uyen T Nguyen
(74) *Attorney, Agent, or Firm* — McDonald Hopkins LLC

(57) ABSTRACT

The present invention relates to a braiding machine with at least two impellers for displacing at least one clapper, wherein the clapper is made at least partially of a ferromagnetic material and wherein each of the impellers has at least one clapper receiver comprising a plurality of electromagnets, wherein the electromagnets enclose a partial circumference of the clapper of about 50° to about 120°.

8 Claims, 26 Drawing Sheets

(56) References Cited

U.S. PATENT DOCUMENTS

| | | | | |
|---|---|---|---|---|
| 2015/0299916 | A1* | 10/2015 | Reinisch | D04C 3/44<br>87/3 |
| 2019/0085490 | A1* | 3/2019 | Jarrell | D04C 3/24 |

FOREIGN PATENT DOCUMENTS

| | | | | |
|---|---|---|---|---|
| EP | 2905366 | A1 | | 2/2014 |
| FR | 2804133 | A1 | | 7/2001 |
| JP | 01250438 | A | * | 10/1989 |
| JP | H01250438 | A | | 10/1989 |

* cited by examiner 2
3
1
3

HIGH SPEED BRAIDING MACHINE WITH MAGNETIC IMPELLERS

CROSS-REFERENCE TO RELATED APPLICATION

The present application claims priority to and the benefit of German Application No. 102017000467.6, filed on Jan. 19, 2017, which is incorporated herein by reference in its entirety.

DESCRIPTION

The present invention relates to a braiding machine.

The published patent application DE 10 2011 012 166 A1 describes a braiding machine which makes it possible to produce any braiding patterns. Different courses are connected or combined with each other by means of a mechanical switch in order to achieve different braiding patterns. Switching courses takes time. This is directly related to the course length. The shorter the length of the course between two switching points, the faster the switching must be as the clapper movement will otherwise be interrupted until the switching positioning is completed.

It would be desirable to have a braiding machine that may produce any braiding pattern without long set-up times or downtimes. In addition, the braiding machine should be able to perform a braiding operation with high speed and high reliability.

The object of the invention lies in the creation of a braiding machine with high flexibility and high braiding speed while offering, at the same time, high reliability.

This object is solved by the features of the independent claims. Advantageous developments are defined in the dependent claims.

According to a first aspect, a braiding machine is provided comprising at least two impellers for displacing at least one clapper, wherein the clapper is at least partially made of a ferromagnetic material, and each of the impellers has at least one clapper receiver having a plurality of electromagnets, wherein the electromagnets enclose a partial circumference of the clapper from about 50° to about 120°.

Due to the electromagnetic clapper receiver, braiding may be made very flexible because the clappers may be arbitrarily retained or transferred by appropriately activating or deactivating the solenoids to activate or deactivate a magnetic field.

Preferably, a contact surface of the clapper receiver, with which the clapper comes, or may come, into contact, comprises a plurality of flat surfaces corresponding to the number of electromagnets. The flat surfaces, in connection with a cylindrical clapper, have the advantage that adhesion is not so great as to accelerate a transfer of the clapper.

According to another aspect, a braiding machine is provided which comprises at least two impellers for displacing at least one clapper, wherein the clapper is at least partially made of a ferromagnetic material, while each of the impellers comprises at least one clapper receiver comprising an electromagnet, wherein the electromagnet encloses a partial circumference of the clapper of about 50° to about 120°, and has the shape of a letter L with two legs of substantially equal length, while a contact surface with which the clapper comes, or may come, into contact is formed along both legs.

The L-shape of the electromagnets approximates the shape of the clapper receiver in order to reduce the distance to the clapper. As a result, the clapper may be held securely by a very low magnetic field. In addition, the low magnetic field may be activated and deactivated more quickly in order to accelerate the clapper transfer and thus the braiding process.

Preferably, the electromagnets have two coils or coil sections, which are respectively associated with one of the legs of the L-shape, and/or a contact surface of the clapper receiver has an arcuate shape corresponding to an outer contour of the clapper.

Preferably, the electromagnets of an impeller delivering the clapper are turned off prior to a handover point and/or the solenoids of an impeller taking over the clapper are turned on prior to the transfer point and/or the coils or coil sections or individual electromagnets are activated/deactivated by being supplied with a different voltage and/or different power and/or with a time delay.

More preferably, the electromagnets are switched on or off at about 20° to about 80° before the transfer point.

Preferably, a plurality of impellers is arranged on a flat surface above one another and side by side in rows and columns or in a circle.

More preferably, a plurality of impellers is arranged in concentric circles, wherein each of the concentric circles has the same number of impellers.

According to a further preferred embodiment, at least one additional impeller is arranged in a space between at least two of the concentric circles.

More preferably, a plurality of impellers is arranged on the circumference of a cylinder, so that all the clappers are directed towards the axis of the cylinder, or a plurality of impellers is arranged on the surface of a hemisphere, so that all the clappers are at the same distance from the braiding point at the center of the hemisphere.

The invention will now be explained in more detail by means of embodiments with reference to the drawings. Although individual embodiments are described separately, the individual features of the various embodiments may be combined to form other embodiments that are also intended to be covered by the present disclosure.

Figure 1:
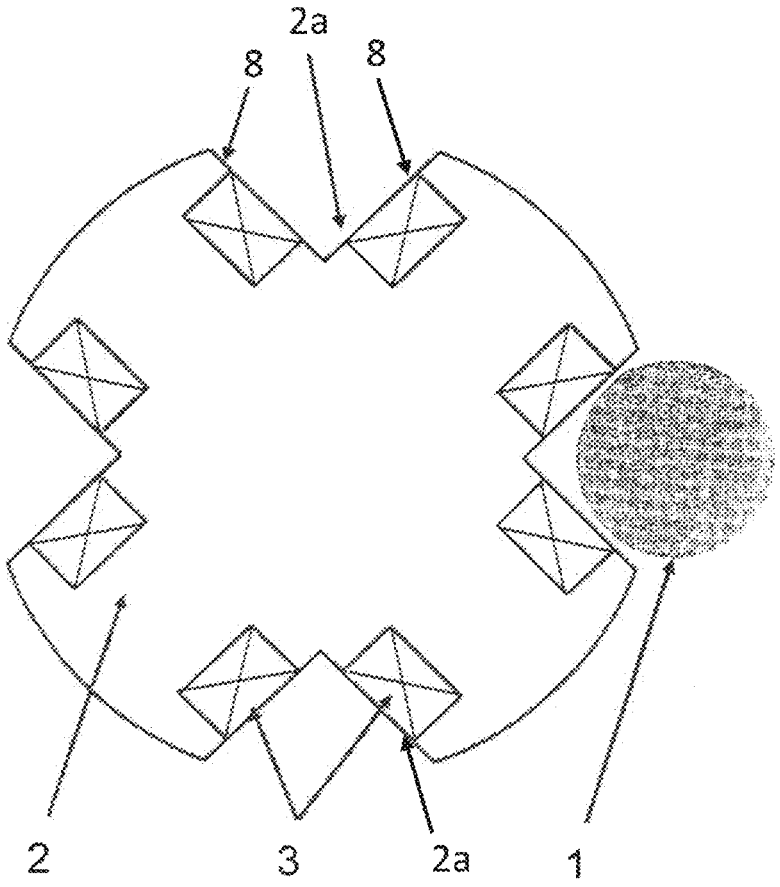
FIG. 1 shows an impeller according to a first embodiment.

FIG. 1 shows an impeller or clapper carrier 2 according to a first embodiment, which has a plurality, in particular four, clapper receivers 2*a* offset by about 90°, and in which at least one clapper 1 may be at least partially received and held when associated electromagnets 3 arranged on or in the clapper receiver 2*a* are activated when the electromagnets 3 are supplied with power.

It should be understood that the invention is not limited to impellers 2 with four clapper receivers 2*a*, but that the impellers 2 may have any number of clapper receivers 2*a*, such as one, two, three, five or more clapper receivers 2*a*. In addition, the clapper receivers 2*a* need not have the same angular distance from each other on the circumference of the impeller 2, but may also be arranged irregularly on the circumference of the impeller 2.

Each of the clapper receivers 2*a* in FIG. 1 have a pair of electromagnets 3, 3, which are arranged on substantially flat or level contact or adhesive surfaces 8, 8, of the clapper receivers 2*a*. An outer circumference of a clapper 1 lies against these adhesive surfaces 8, 8, and adheres thereto due to the attracting magnetic force of the electromagnets 3, 3, when they are supplied with power, because the clapper 1 is at least partially magnetic, or consists of a magnetic material, as will be described later.

If the magnetic field is delayed due to the latency after switching off the current, the clapper 1 is released from the clapper receiver 2*a* and may be, for example, transferred to another impeller (not shown in FIG. 1) along a removal path.

Figure 2:
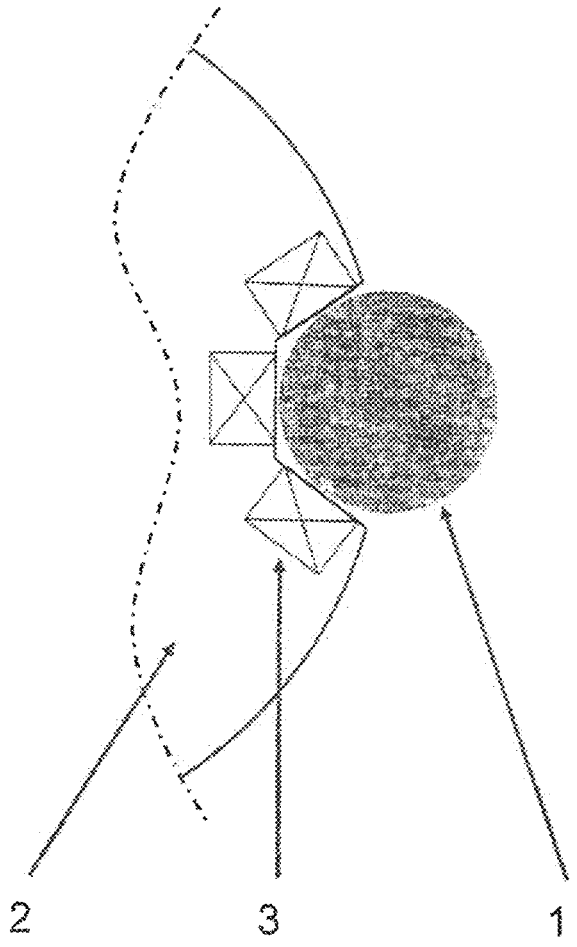
FIG. 2 shows a partial view of an impeller according to a second embodiment.

FIG. 2 shows a second exemplary embodiment of a clapper receiver 2*a* of an impeller 2, wherein three electromagnets 3 are correspondingly arranged on three substantially flat contact or adhesive surfaces 8. The electromagnets 3 of the second embodiment may be made smaller compared to the electromagnets 3 of the first embodiment while producing the same adhesive force, because each of the electromagnets 3 need only generate one third of the total adhesive force, while, in the first embodiment, each of the two electromagnets 3 must generate half of the total adhesive force. The smaller electromagnets 3 thus offer the advantage that their magnetic field may be activated and deactivated faster because the magnetic field of each of the three electromagnets 3 is smaller.

Figure 3:
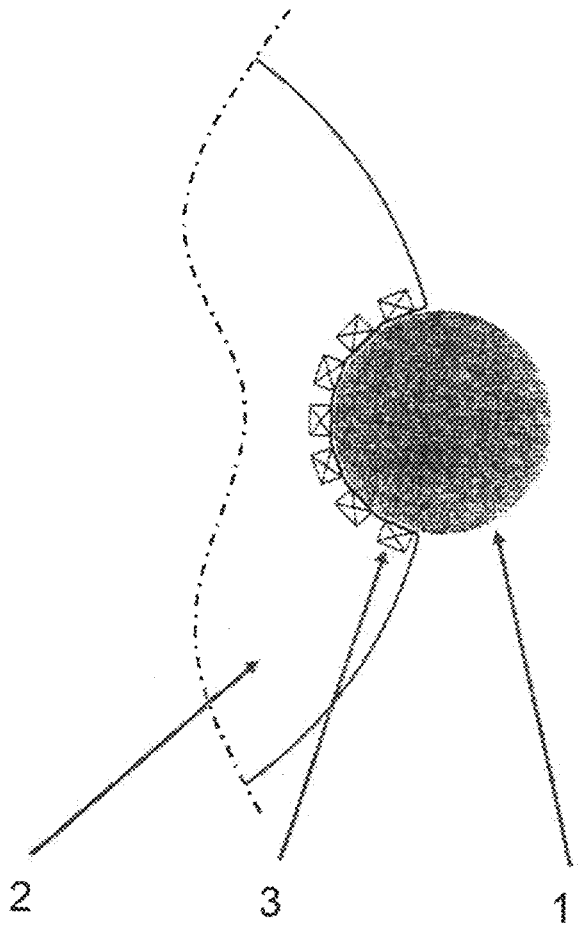
FIG. 3 shows a partial view of an impeller according to a third embodiment.

FIG. 3 shows a third embodiment with a part-circular adhesive surface 8, on whose course a plurality of small electromagnets 3 is arranged. According to this embodiment, the magnetic field may be activated and deactivated even faster compared to the first and second embodiments. In addition, the cylindrical clapper 1 is in substantially flat contact (in particular full-surface) with the adhesive surface 8, so that sufficient adhesive force may be generated even with a low magnetic field due to improved magnetic coupling. As a result of the lower magnetic field needed to create sufficient adhesive force, the activation and deactivation of the magnetic field may be further accelerated.

Figure 4:
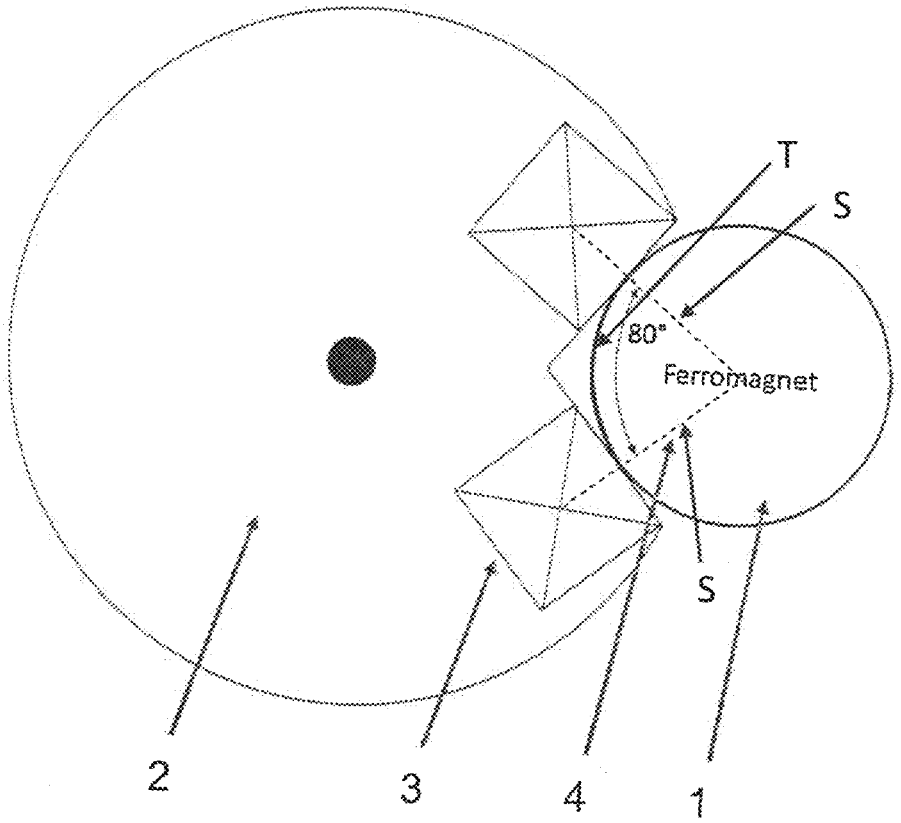
FIG. 4 shows an explanatory view of the impeller according to the first embodiment.
Figure 5:
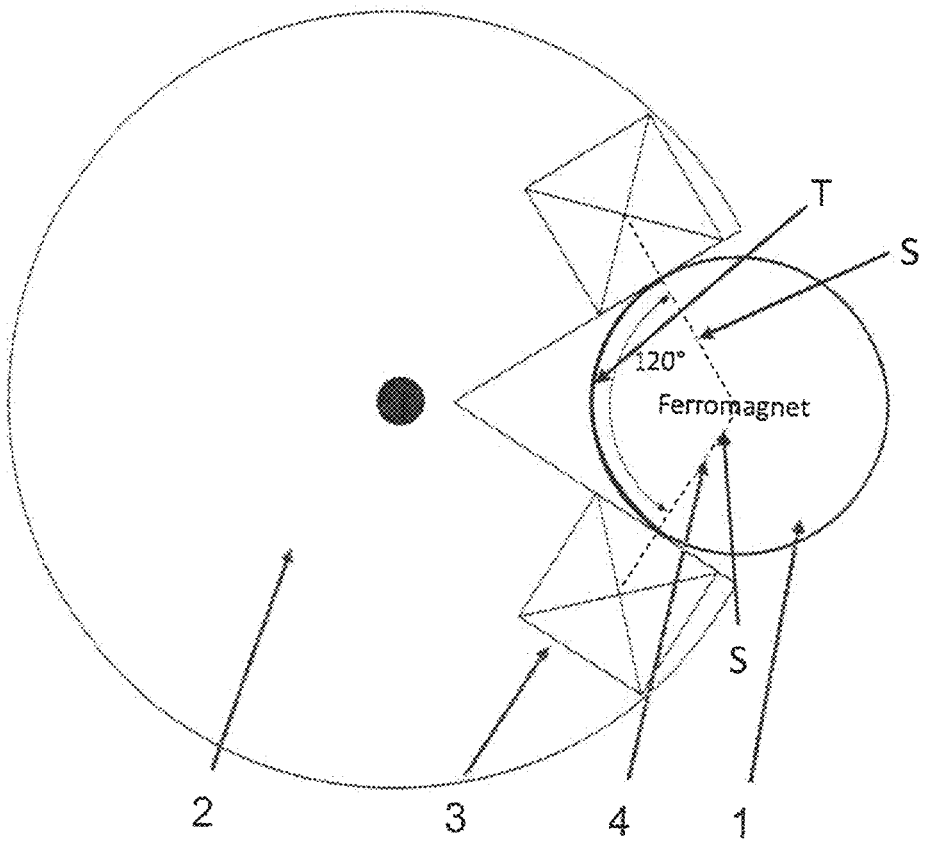
FIG. 5 shows an explanatory view of the impeller according to a modification of the first embodiment.

FIGS. 4 and 5 show different angles 4 of the clapper receiver 2*a*, while FIG. 4 shows an opening angle or angle 4, which encloses the vertical S of the adhesive surfaces 8 by approximately 80°, while the exemplary embodiment of FIG. 5 has an angle 4 between the vertical lines S of about 120°. As shown in FIGS. 4 and 5, the cylindrical clapper 1 abuts the flat adhesive surfaces 8 by line contact. A straight line drawn through the contact point or the contact line running perpendicular to the adhesive surface 8 respectively form the vertical lines S. The angle 4 is defined as the angle formed between the vertical lines S on the side of the clapper receiver 2*a*.

The inventors recognized that an angle 4 formed by the vertical lines S of the adjacent adhesive surfaces 8 should lie within a range of about 50° to about 120°. Preferably, the angle 4 should be in the range of about 80° to about 110°, most preferably in the range of about 90° to about 100°. The angle 4 thus encloses a partial circumference T of the cylindrical clapper 1.

The specified angular ranges offer the advantage of good adhesion of the clapper 1 with simultaneous rapid activation and deactivation of the magnetic field of the electromagnets 3 in order to accelerate clapper transfer. Thus, safe and reliable braiding may be performed at high speed.

In addition, a transfer angle, i.e. the angle of the relative position of adjacent impellers 2 with respect to each other during rotation of the impellers 2, is increased when, due to the preferred angular range, a high magnetic attraction force is exerted on the clappers 1. The term "transfer angle" is to be understood as the angle, which is passed during rotation of the impellers 2, starting from the release of the clapper 1 from the adhesive surface 8 of the forwarding impeller 2 to the arrival of the clapper 1 at the adhesive surface 8 of the receiving impeller. 2

Figure 6:
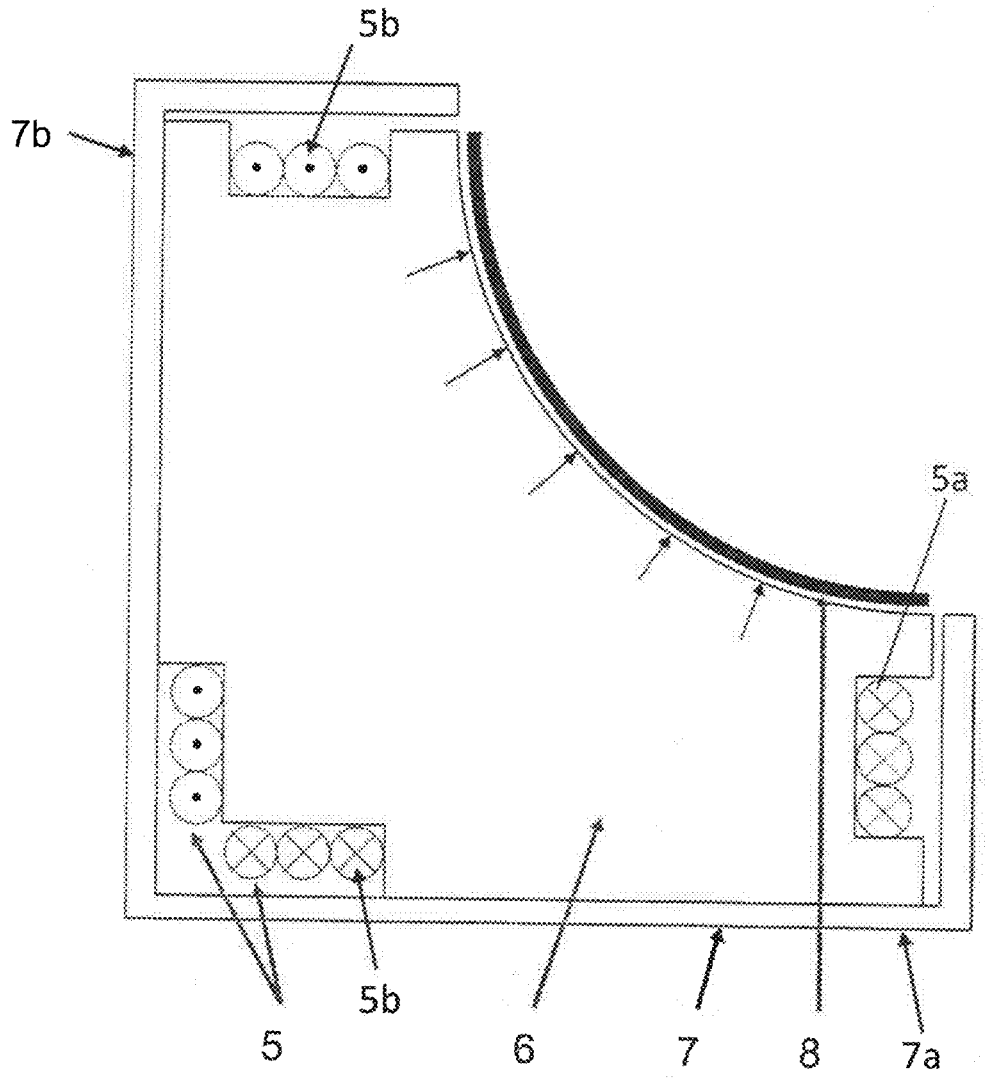
FIG. 6 shows an electromagnet according to a fourth embodiment.

FIG. 6 shows an electromagnet 3 according to a fourth embodiment, which has the shape of a letter L. A magnet housing 7 with two legs 7*a*, 7*b* of substantially equal length has an L-shape and accommodates an L-shaped magnetic core 6, which has a coil or a coil section 5*a*, 5*b* on each leg 7*a*, 7*b*. Each of the coils 5*a*, 5*b* has a winding with at least one electrical conductor 5 in order to form an electromagnet 3 interacting with the magnetic core 6.

A substantially part-circular or arcuate adhesive surface 8 is provided on the legs 7*a*, 7*b* of the L-shape, which corresponds to an outer contour of the clapper 1 in order to provide good adhesion of the clapper 1 to the adhesive surface 8.

Preferably, each coil or each coil section 5*a*, 5*b* may be controlled separately or may create a different high magnetic field. This may be achieved, for example, by the coils or coil sections 5*a*, 5*b* being supplied with power at different times, or the coils or coil sections 5*a*, 5*b* being supplied with a different high voltage and/or different high current. Another possibility for creating a different magnetic field is that the number of windings of one coil 5*a* may be different from the number of windings of the other coil 5*b*.

The advantage of the two coils or coil sections 5*a*, 5*b* having a different high magnetic field is that the transfer of the clapper 1 may be further optimized or accelerated, for example, when one of the legs 7*a* behind the other leg 7*b* in the direction of rotation of the impeller 2, has a stronger or weaker magnetic field and/or a magnetic field that is activated or deactivated with a delay with respect to the other leg 7*b*.

It should be understood per se that the creation of different high magnetic fields and/or delayed activation is not limited to the embodiment of FIG. 6, but is also possible in the embodiments of FIGS. 1 to 3.

Figure 7:
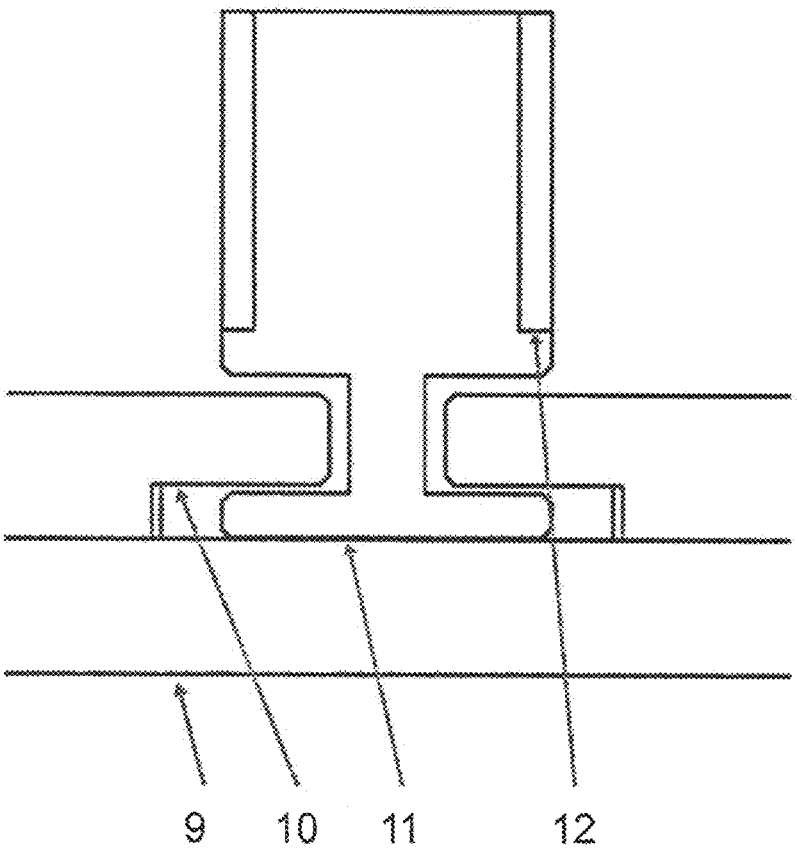
FIG. 7 shows a clapper with a guide element.

FIG. 7 shows a detailed view of a clapper 1 having a substantially cylindrical shape, wherein a ferromagnetic material 12 is provided or arranged on an outer circumference of the cylinder in order to hold the clapper 1 in the clapper receiver 2*a* of an impeller 2 by means of the electromagnets 3. However, the invention is not limited to the arrangement of the ferromagnetic material 12. Rather, the entire clapper 1, or at least parts thereof, may be made of ferromagnetic material.

Preferably, moreover, the clapper 1 has a sliding element 11 (in particular circular or wheel-shaped) at one axial end of the cylindrical shape in order to be mechanically guided by a corresponding mechanical guide element 10 of the braiding machine.

Figure 8:
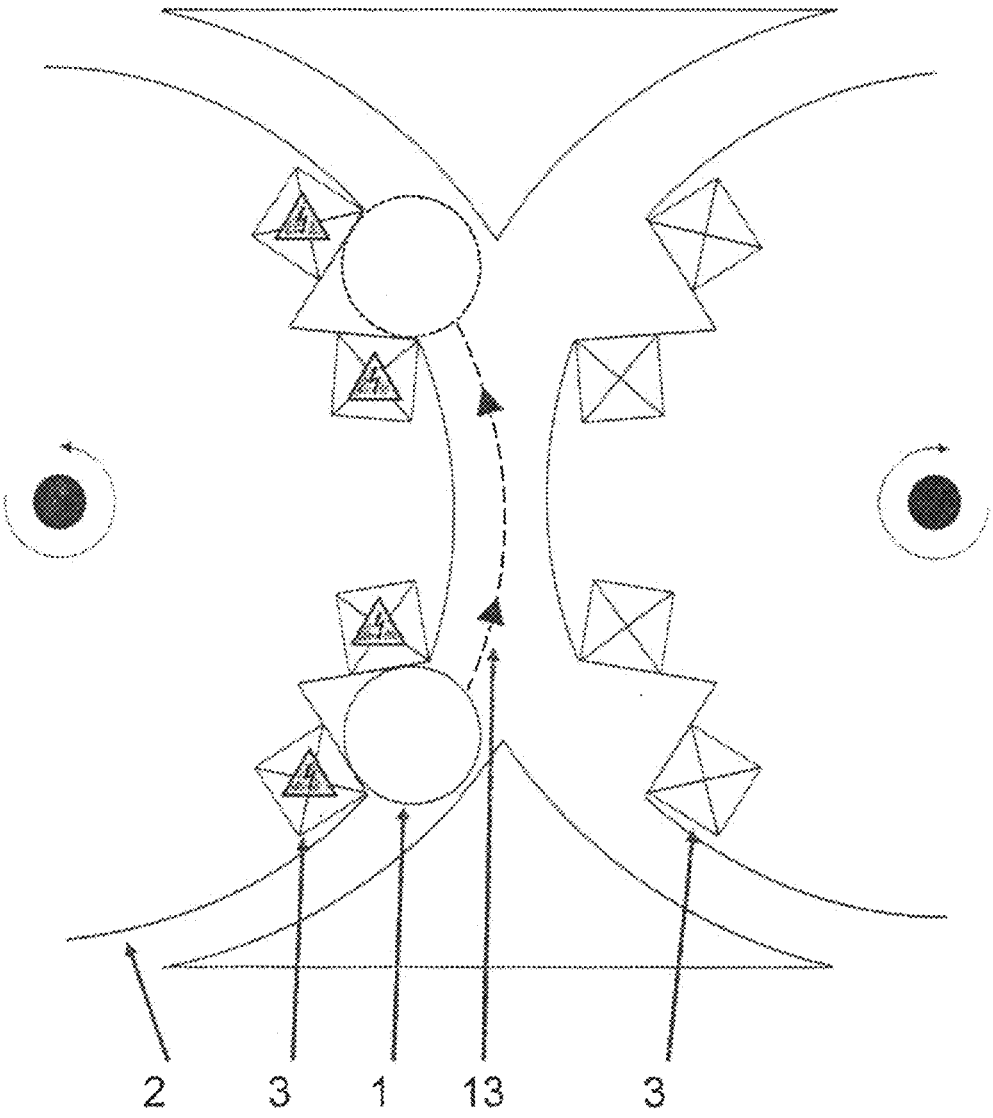
FIG. 8 shows the course of a clapper in the braiding machine according to the invention, wherein the clapper remains on the impeller and the direction of movement is maintained.

FIG. 8 shows the course of the clapper 1 in the braiding machine according to the invention, when the clapper 1 remains on the impeller 2 and the direction of movement is maintained. In this case, as shown in FIG. 8, the electromagnets 3 of the clapper receiver 2*a* in which the clapper 1 is located, remain activated to hold the clapper 1 by the adhesive force of the electromagnets 3. On the other hand, the electromagnets 3 of the adjacent impeller 2 (on the right in FIG. 8) remain deactivated because no transfer of the clapper 1 should take place.

Figure 9:
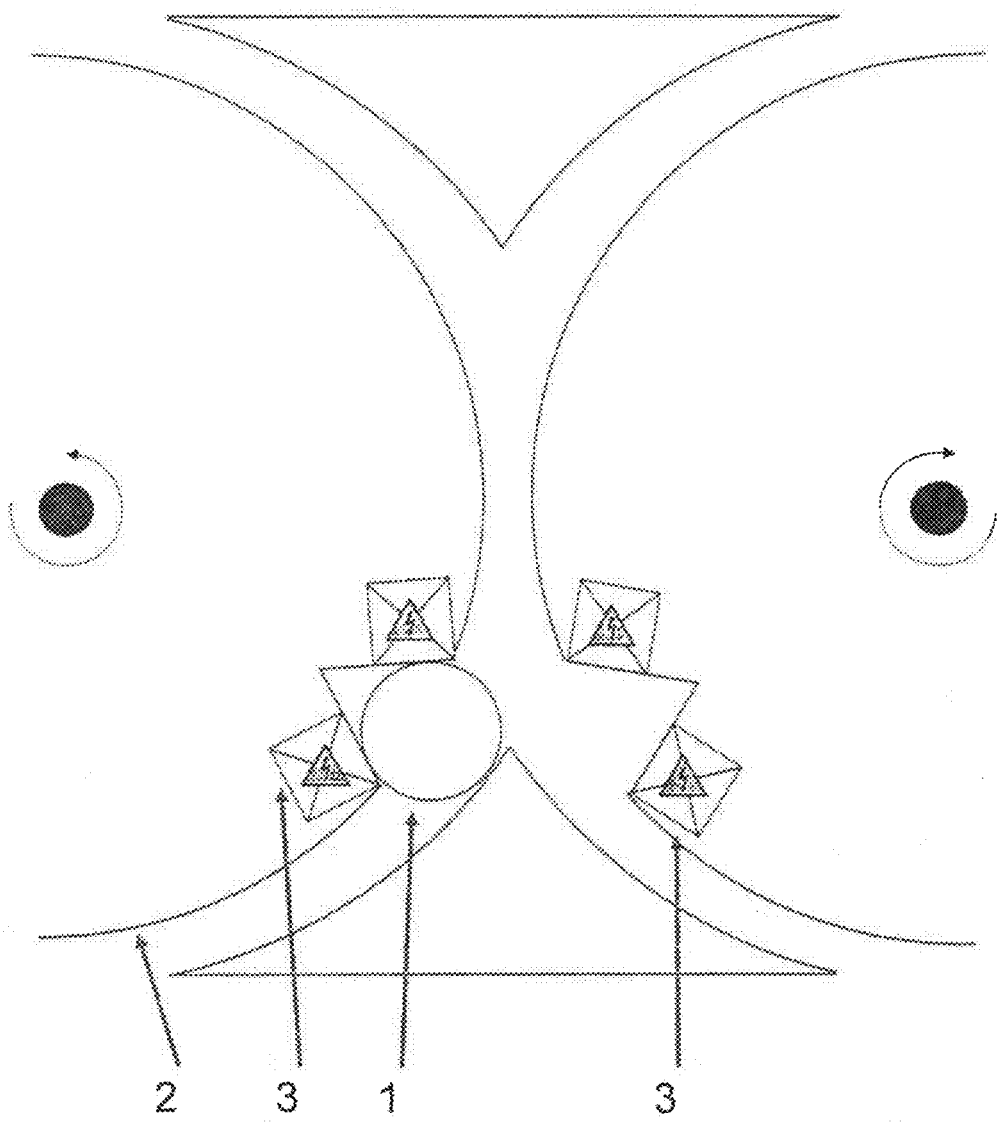
FIGS. 9 to 12 show the sequence of movement of a clapper in the braiding machine according to the invention, wherein the clapper is transferred from one impeller to the adjacent impeller and the direction of movement is maintained.

FIGS. 9 to 12 show the sequence of movements of the clapper 1 in an embodiment of the braiding machine according to the invention, when the clapper 1 is transferred from one rotating impeller 2 to the adjacent rotating impeller 2 while the direction of movement is maintained. In this case, the electromagnets 3 in the relative position of the adjacent impellers 2 shown in FIG. 9 are activated both in case of the forwarding impeller 2 (impeller 2 on the left in FIG. 9) as well as in the case of the receiving impeller 2 (impeller 2 on the right in FIG. 9). In the relative position of the two impellers 2 shown in FIG. 9, the clapper 1 remains on the forwarding impeller 2 due to the smaller distance to the electromagnet 3 and the resulting stronger magnetic field. Thus, one or more clappers 1 are received in the respective clapper receivers 2*a* of the respective impeller(s) 2 and are positioned or held therein by means of the magnets 3 associated therewith. The impellers 2 are rotated relative to one another (in particular with a substantially identical angular velocity), so that the clapper receivers 2*a* respectively corresponding to one of the two impellers 2, are adjacent to one another in a plurality of circumferential positions, in particular on reference lines leading through the central axis. By correspondingly controlling or regulating the associated magnets 3, the clapper 1 of the other adjacent clapper receiver 2*a* of the adjacent impeller 2 arranged in one clapper receiver 2*a* may thus be displaced or transferred, so that in this transfer step the clapper 1 is transferred between respectively selected pairs of adjacent clapper receivers 2*a* of the impellers 2. Thus, the assignment of a clapper 1 to a first or a second impeller 2 at each circumferential position may be performed independently of a transfer position assignment of the clappers 1 to the two impellers 2 on the clapper receivers 2*a* at other circumferential positions. By "assignment" is meant, in particular, an optional arrangement or retention of an existing clapper arrangement or position on an impeller 2 or clapper displacement or transfer to the respective other impeller 2. In particular, an assignment of the clapper position to each pair of clapper receivers may be made independently of the assignment to another pair of clapper receivers or circumferential positions. In particular, the angle of rotation and/or the direction of rotation of the adjacent impellers 2 may be optionally different, or positive or negative, so that both directions of rotation (even independently) are possible.

Figure 10:
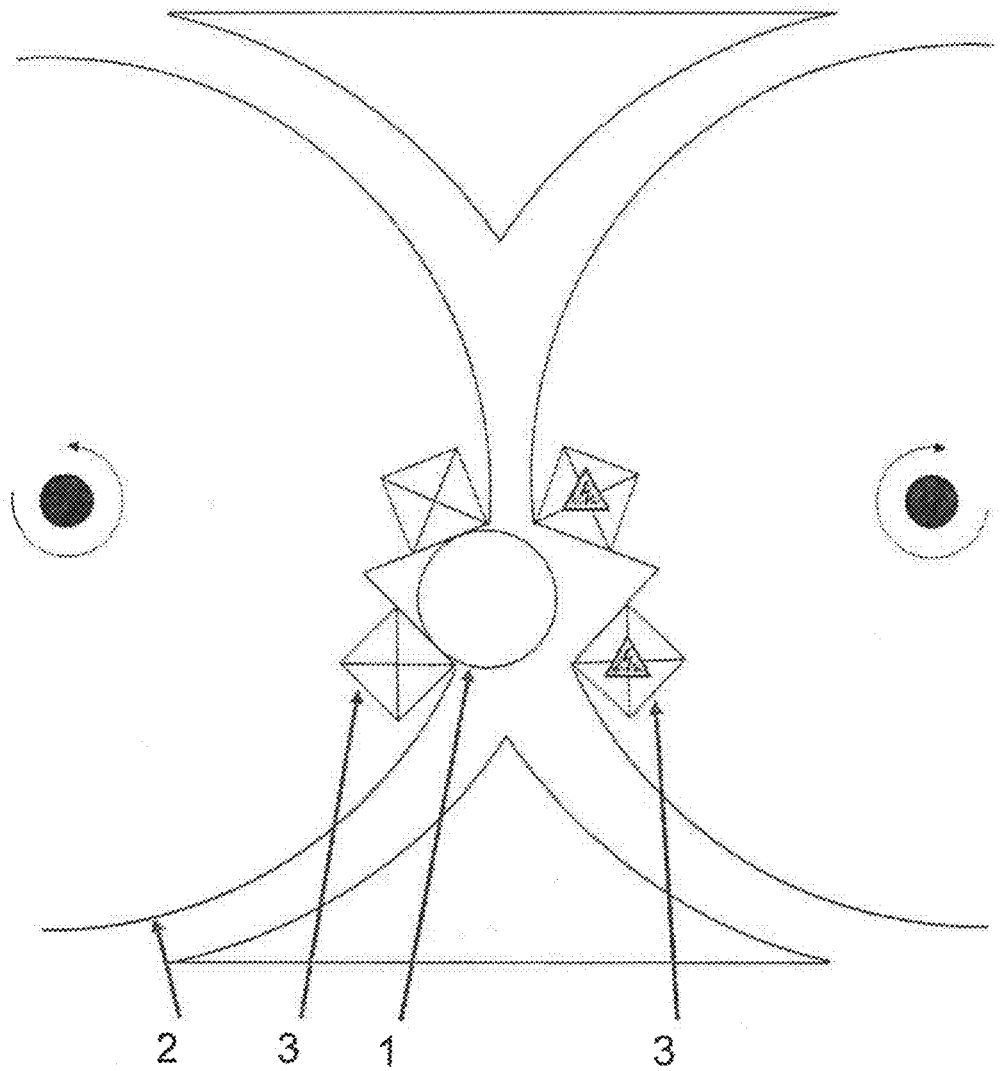
Figure 11:
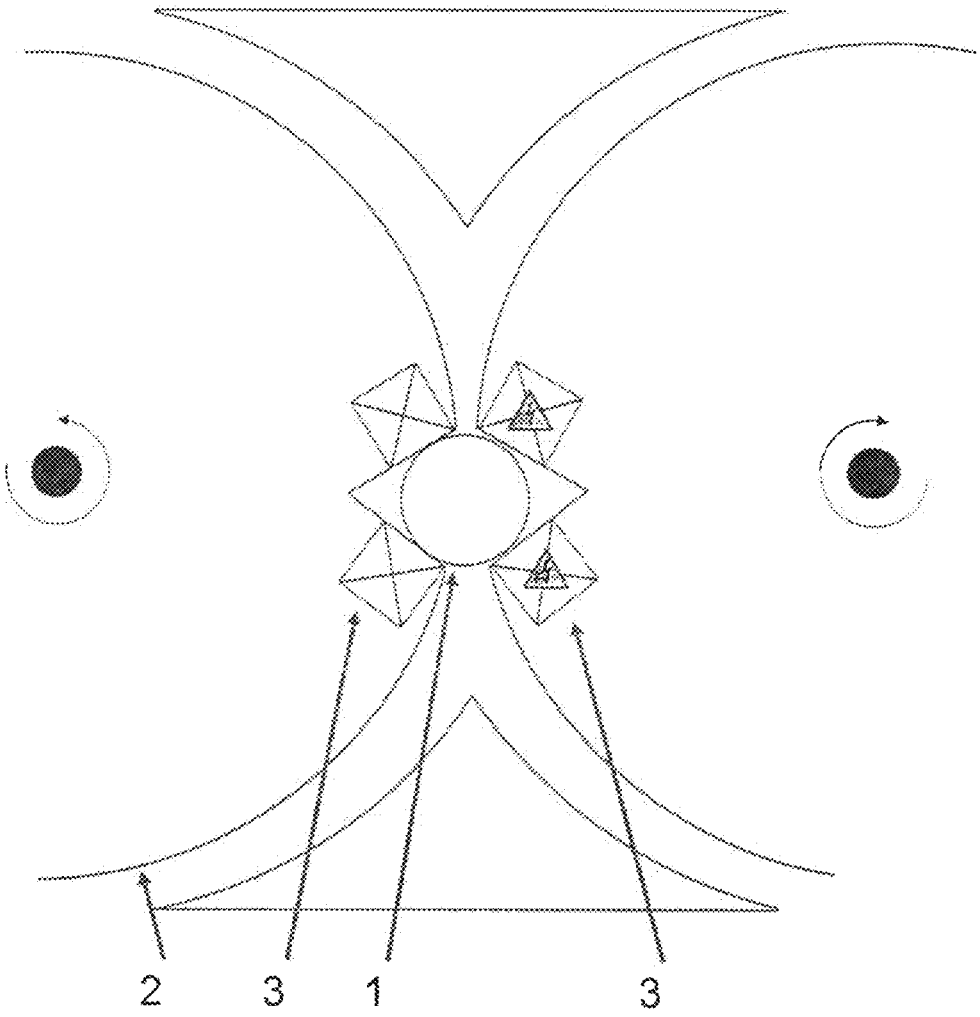
Figure 12:
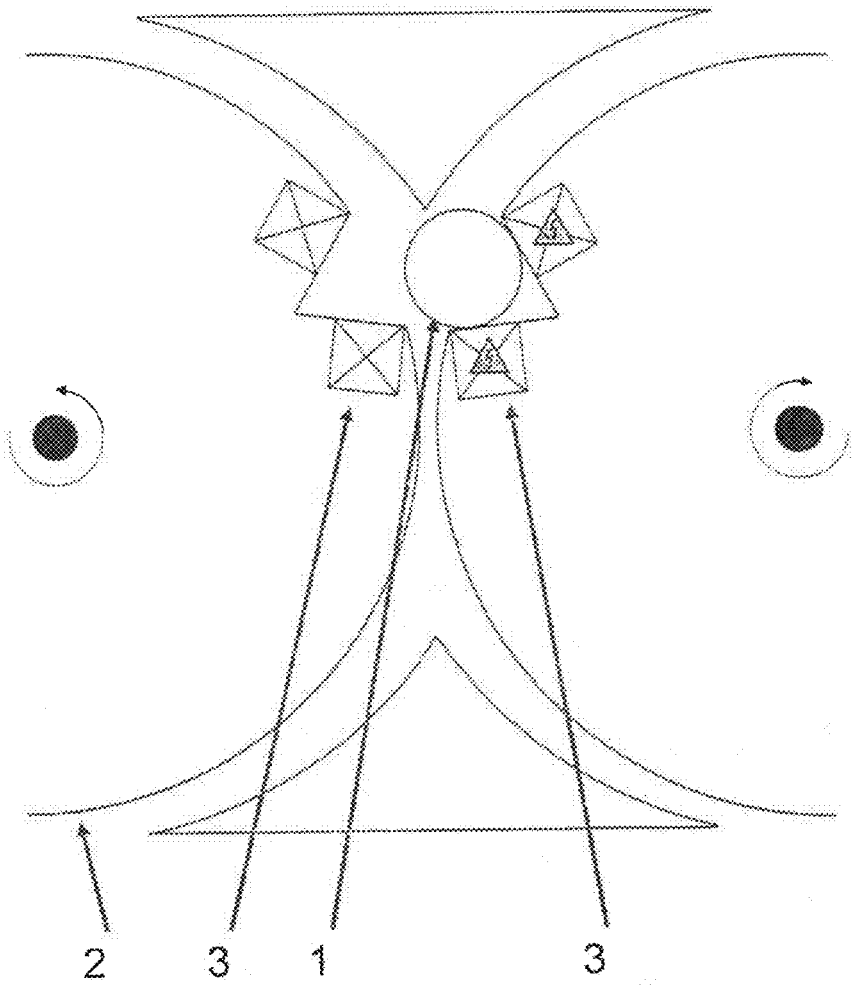
Figure 13:
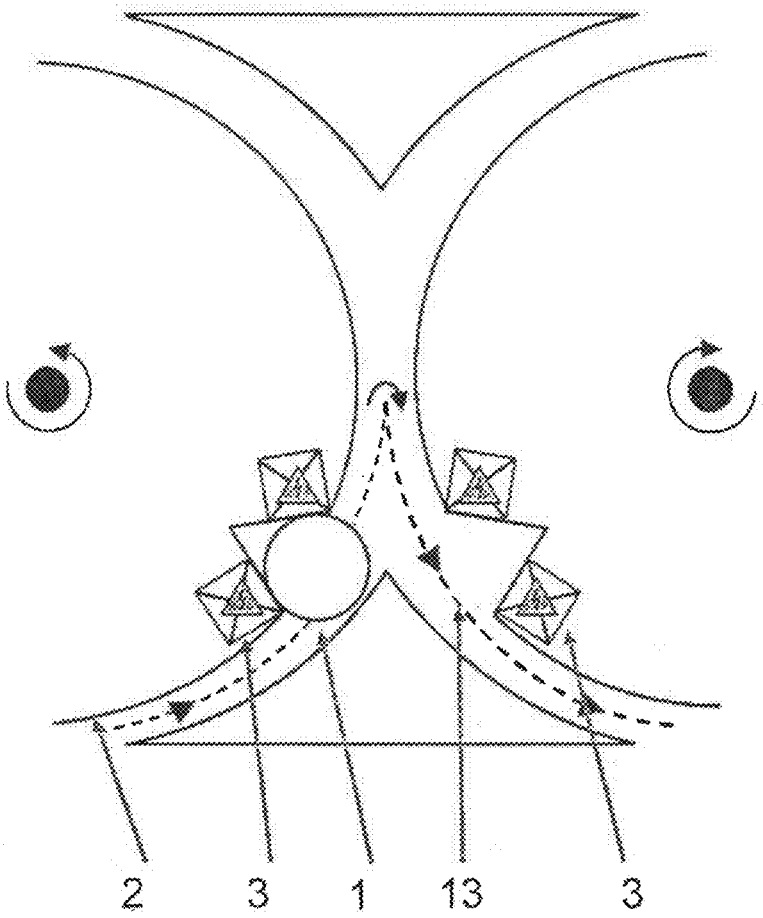
FIGS. 13 to 16 show the sequence of movement of a clapper in the braiding machine according to the invention, wherein the clapper is transferred from one impeller to the adjacent impeller and the direction of movement is changed.
Figure 14:
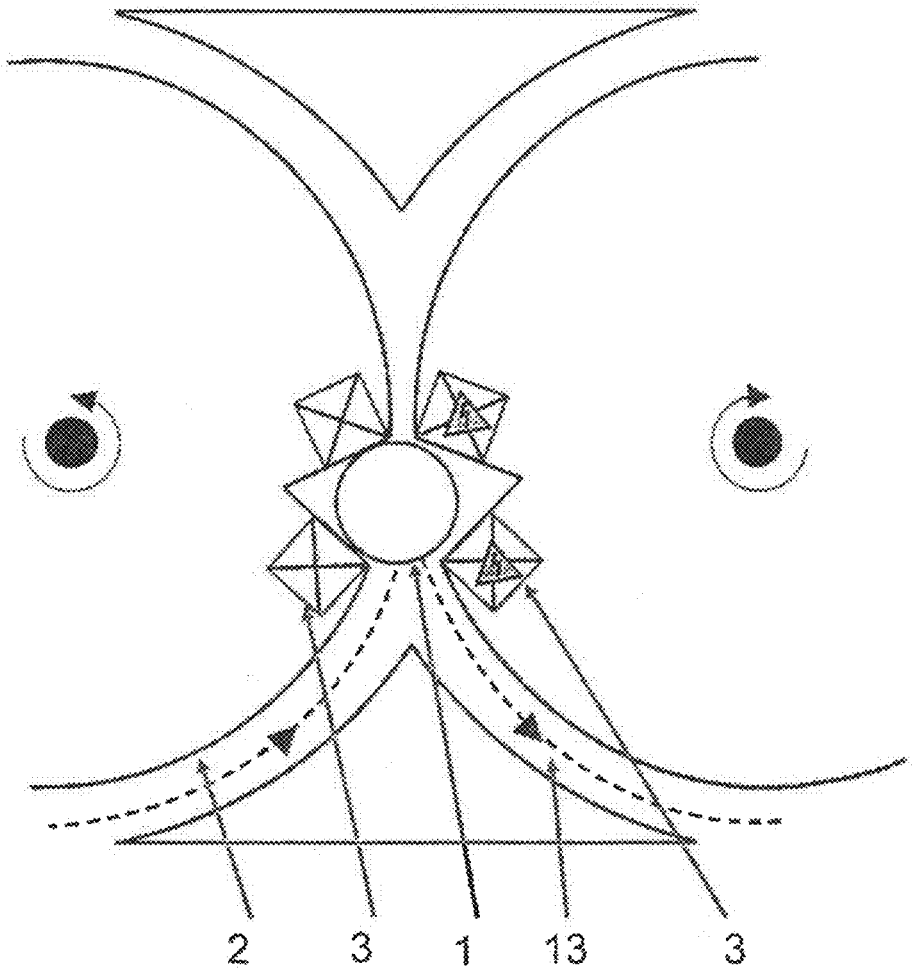
Figure 15:
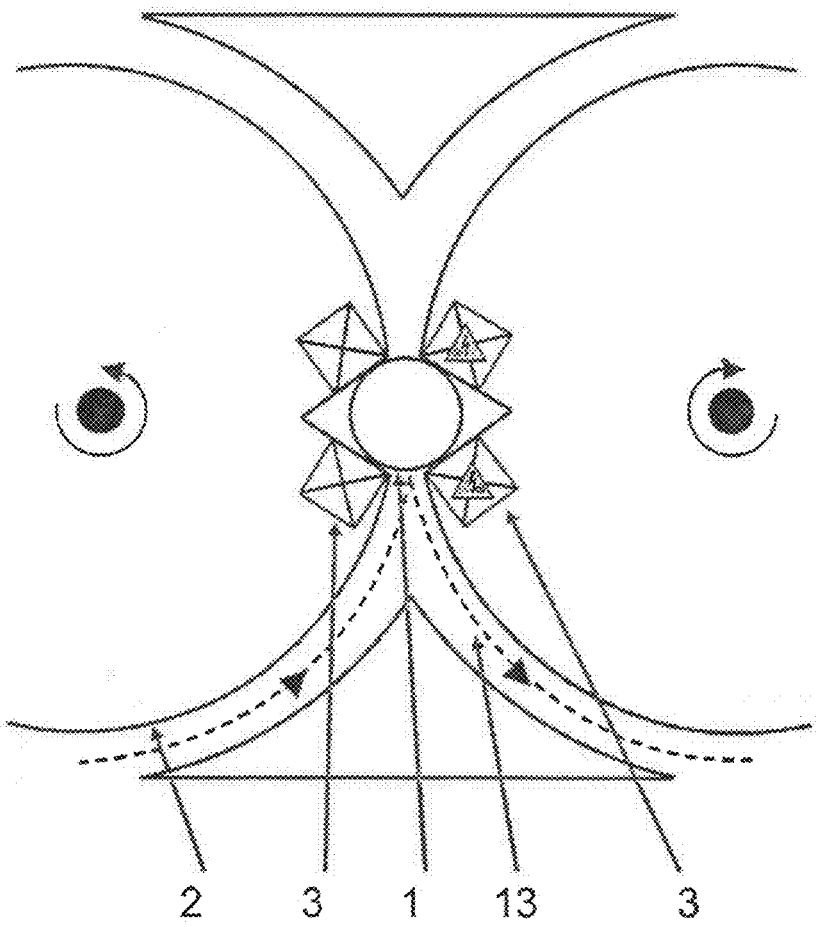
Figure 16:
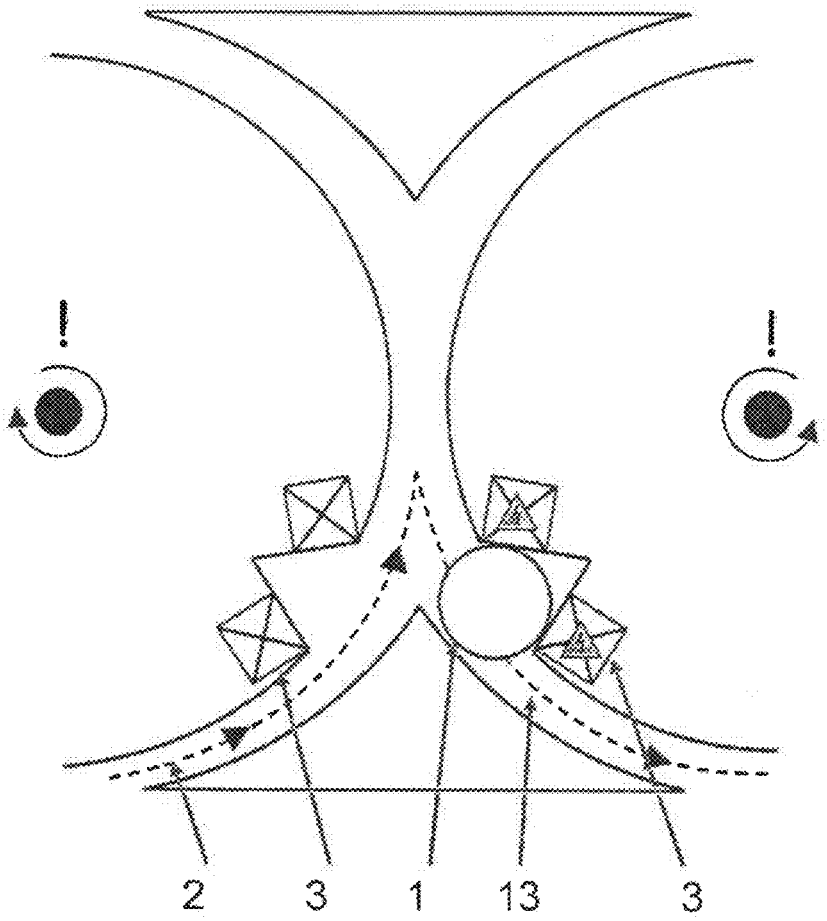

Just before the transfer point 14, i.e. just before the clapper receivers 2*a* of the adjacent impellers 2 lie directly opposite as shown in FIG. 10, the electromagnets 3 of the forwarding impeller 2 are deactivated to allow the transfer as shown in FIG. 11. Then, the clapper 1 rotates together with the receiving impeller 2 as shown in FIG. 12.

FIGS. 13 to 16 show a movement sequence of the clapper 1, wherein clapper 1 is transferred from an impeller 2 to the adjacent impeller 2 and the direction of movement is changed. In this case, FIGS. 13 and 14 correspond to FIGS. 10 and 11, while the circuit of the electromagnets 3 remains the same so it is not repeated here. In contrast to the sequence of movements shown in FIG. 12 and according to FIGS. 15 and 16, the direction of rotation of the receiving impeller 2 is reversed so that the clapper 1 follows the rotation of the impeller 2 shown on the right in FIGS. 15 and 16 after the transfer.

Figure 17:
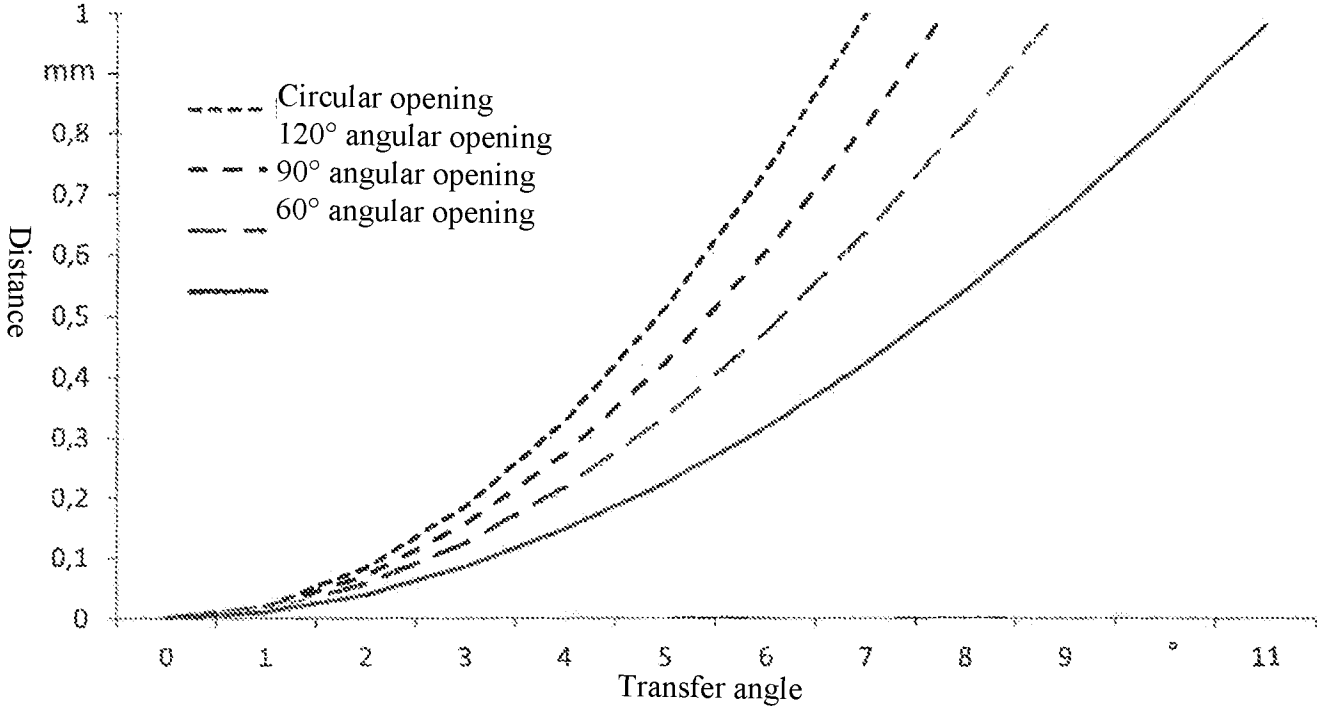
FIG. 17 shows a diagram with possible transfer angles at different angular openings of the clapper receivers of the impellers.

The greater a transfer angle, the more the remaining time for the transfer of the clapper 1. A high value is therefore desirable. Based on the descriptions and figures, it is already clear that the transfer angle when using a part-circular clapper receiver 2*a* and the application of only one electromagnet 3, is significantly lower than when using a plurality of electromagnets 3 in a mutual angular arrangement. To substantiate this statement, corresponding calculations have been made, the results of which are shown in FIG. 17. The distances at different transfer angles are shown. In addition to the part-circular clapper receiver 2*a*, angle openings are shown in a range between 60° and 120°.

Based on the fact that a magnet of a suitable size can no longer exert an attracting force when the distance to the clapper 1 is too long, distance values between 0 and 1 mm are of interest. Impeller designs with clapper receivers 2*a* always achieve a higher transfer angular range with constant cylinder spacing. At a maximum distance of about 1 mm and an angular opening of about 60°, this corresponds to a transfer angular gain of about 170%. For the further determination of the system parameters, therefore, only angular impeller openings are considered.

The investigation of the change in the transfer angle as a function of the impeller opening angle requires, first of all, that both the impeller radius and the impeller clearance remain constant for the calculation. The calculated values are based on the following assumptions and largely reflect realistic properties:

Constant impeller radius of 67.5 mm

Constant impeller clearance of 0 mm

Variation of the impeller opening angle

The impeller opening angle corresponds to the angle which is formed by the two adhesive surfaces 8.8 of the clapper receivers 2*a*.

By "impeller wheel radius" is meant the radius from the center or pivot point of the impeller 2 to the circle outer line of the impeller 2.

By "impeller distance" is meant the distance from the circular outer lines to the two adjacent impellers.

Figure 18:
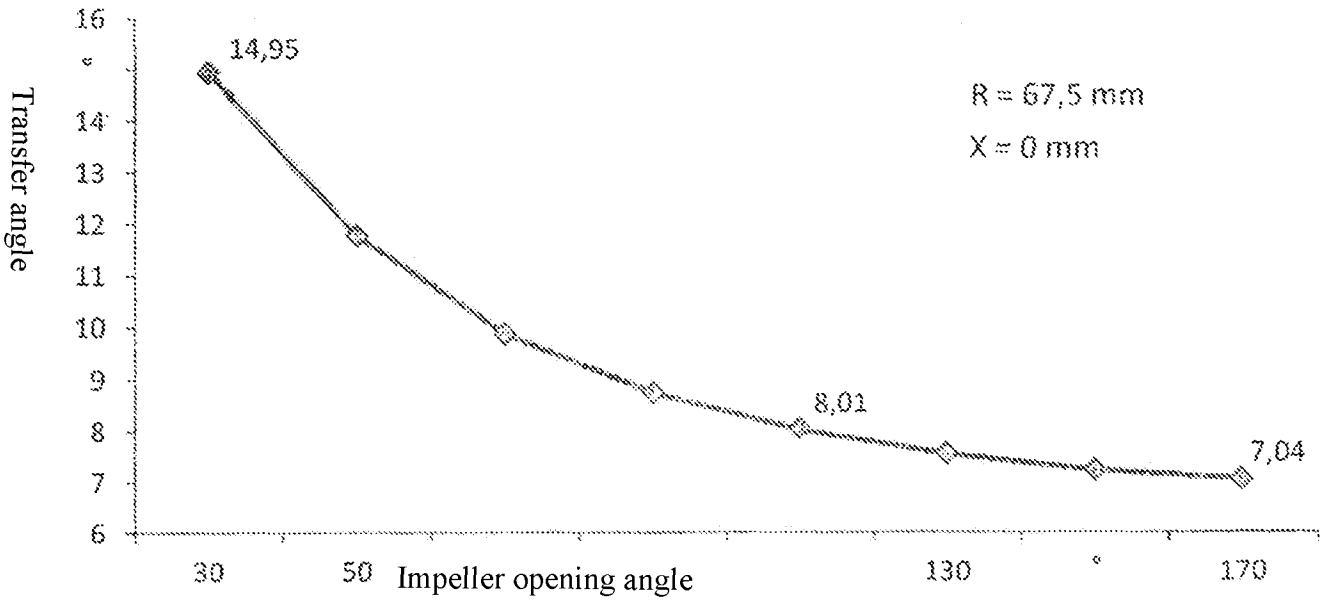
FIG. 18 shows a diagram of a transfer angle as a function of the impeller opening angle.

As the impeller opening angle increases, the transfer angle values will decrease exponentially. FIG. 18 shows the course of the curve with reference to a diagram.

At opening angles between 110° and 170°, the value of the transfer angle changes by just 1° between 30° and 110°, wherein the difference between the maximum and minimum transfer angle is approximately 7°. If the geometrical properties of the electromagnets 3, such as size and shape, are ignored, smaller impeller opening angles are advantageous since a larger range of the transfer angle may be ensured. Useful opening angles lie between about 30° and about 110°, since at values above this range, the change in the transfer angle is minimal.

Figure 19:
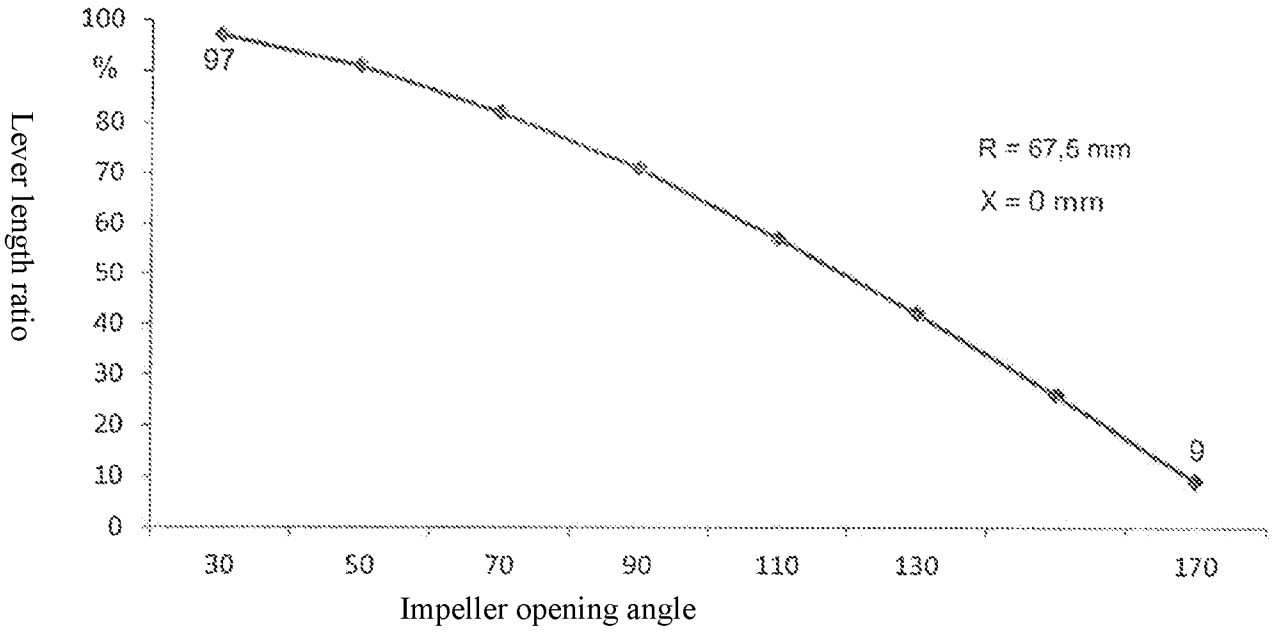
FIG. 19 shows a graph showing a ratio of the lever length as a function of the impeller opening angle.

The impingement of the clapper 1 on the impeller opening results in different loads and torques on the respective motor axis. Depending on the distance of the point of impingement from the clapper 1 and the impeller 2 to the central axis, different leverage ratios may be achieved as shown in FIG. 19. To make the difference clear, opening angles of 50° and 120° are compared.

A 100% leverage corresponds to an impingement of the clapper 1 at the extreme point of the impeller opening, which is approximately equal to the diameter value. The course of the curve may be described essentially by a parabolic drop as shown in FIG. 19. The ratio of the lever length results from the length between the point of impingement of the clapper 1 and the center point. This is compared with the maximum length (value of the impeller diameter) and converted. The calculated values are based on the following assumptions, as in the previous experiments:

Constant impeller radius of 135 mm

Constant impeller clearance of 0 mm

In the stated useful range of the impeller opening angle between about 30° and about 170°, the lever length ratio varies between 97% and 9%, which represents a significant drop. Due to the attracting force of the electromagnet 3, the clapper 1 is accelerated beyond its current path speed and may impinge on an opening edge of the adjacent impeller 2. The larger the resulting torque, the more advantageous it is that the electric motor in question compensates for this shock from the impingement of the clapper 1 on an edge of the impeller 2. It is therefore advantageous to compensate with a motor-side compensation of these shocks upon impingement in order to prevent an increase in load on the braided material used, and thus on the entire braiding to be produced. Thus, braid fractures may be advantageously prevented, which could otherwise lead to an interruption of the braiding process. As a result, the inventors recognized that larger opening angles with respect to the lower leverage are beneficial and may be advantageously taken into account in determining a suitable region for the cylinder transfer.

FIGS. 20 to 26 show different types of round braiding machines with corresponding impellers 2 according to the invention.

Figure 20:
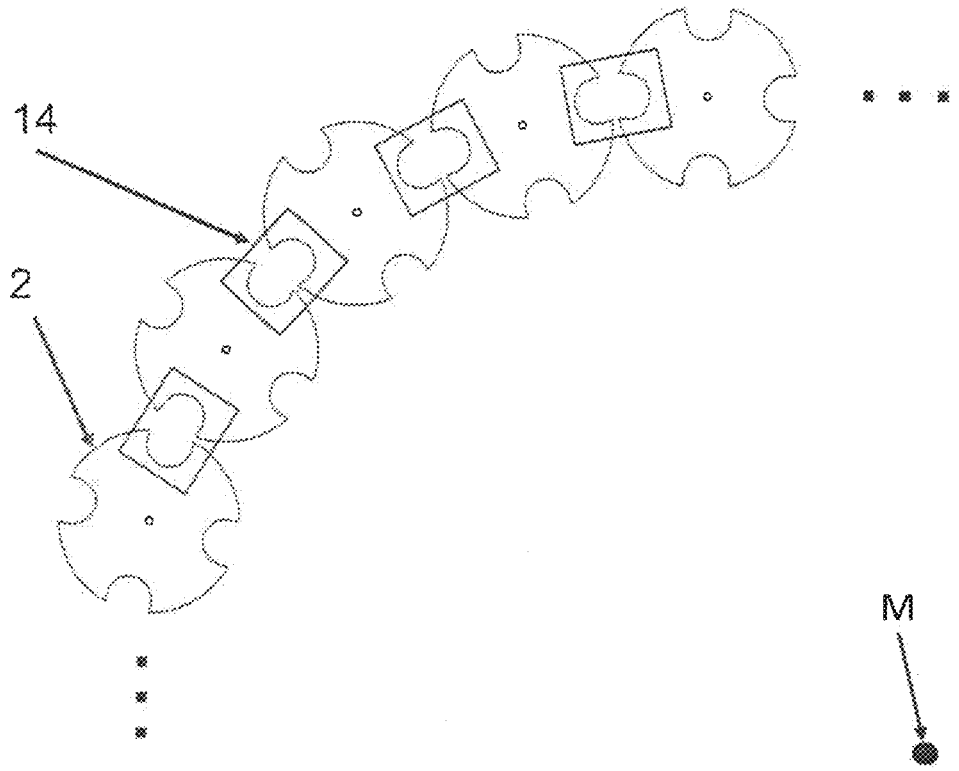
FIG. 20 shows a schematic structure of a conventional round braiding machine with a transfer point according to the invention.

FIG. 20 shows an embodiment of a braiding machine in which a plurality of impellers 2 is arranged on a circle (only partly shown) with the center point M. A transfer point 14 is respectively arranged between two adjacent impellers 2 according to a particular embodiment. Each of the impellers 2 has a clapper receiver 2*a* offset by about 90° along its circumference, thus giving a total of four clapper receivers 2*a* to move the clapper 1 along the circumference of the impeller 2. According to the invention, however, a different number of clapper receivers (for example one, two, three, or five or more clapper receivers 2*a* per impeller 2, is also conceivable. In this way, the clapper 1 may be moved along the circumference of a single impeller 2, or alternatively forwarded to the adjacent impeller 2. It should be understood that in this way a very flexible braiding process may be performed without the machine having to be converted or rebuilt. Furthermore, the transfer of a clapper 1 takes place in a very fast manner just by controlling or activating a respective electromagnet 3.

Figure 21:
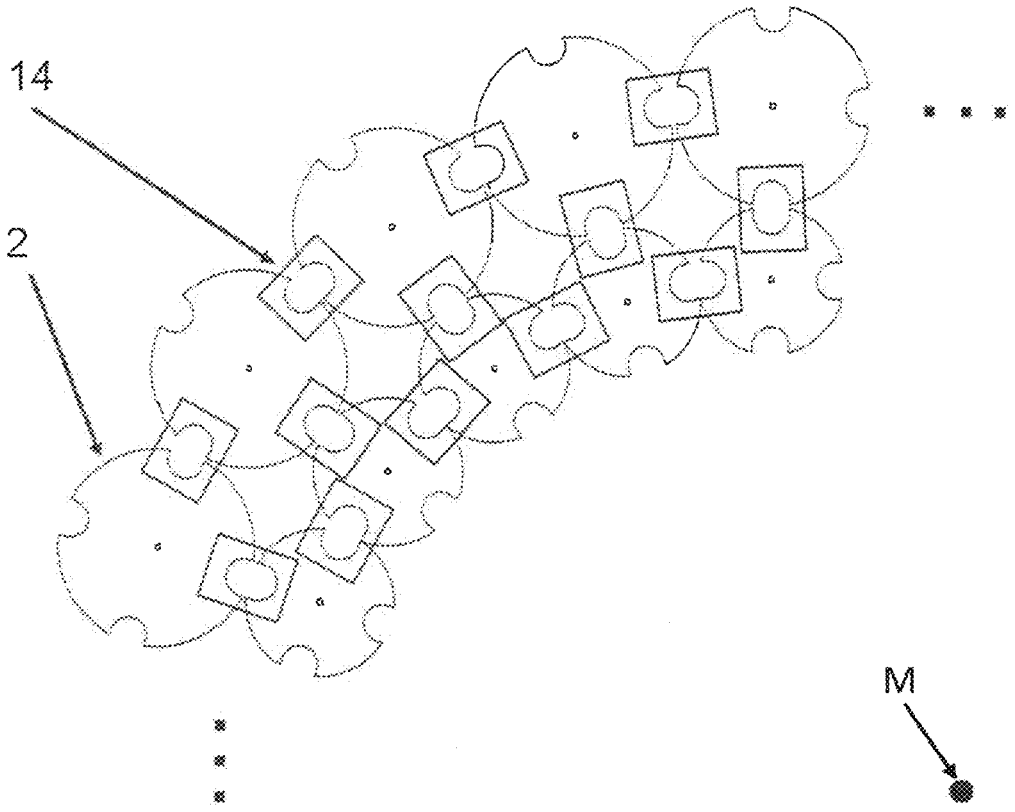
FIG. 21 shows a schematic structure of an enlarged round braiding machine with a plurality of rings.

FIG. 21 shows a further embodiment of a special braiding machine in which a second concentric circle of impellers 2 is substantially arranged around the center point M. In this way, the clappers 1 may be selectively moved along one of the two substantially concentric circles formed by the plurality of impellers 2. In addition, at least one transfer point 14 is preferably arranged between adjacent impellers 2 of one of the circles and one impeller 2 of the other circle. In the illustration of FIG. 21, a transfer point 14 is respectively arranged between adjacent impellers 2 of the one circle and the other circle. In this way, a clapper 1 may be transferred from one of the concentric circles to the other of the concentric circles. In this way, the braiding becomes even more flexible.

It should be understood that the invention is not limited to the arrangement of two substantially concentric circles of the impellers 2, but a plurality of three, four, five or even more substantially concentric circles of impellers 2 may be arranged. Furthermore, the invention is not limited to impellers 2 with four clapper receivers 2*a*, but may also relate to any number of clapper receivers 2*a* arranged on the impeller 2, or on a plurality of impellers 2, or impellers 2 may be combined with a different number of clapper receivers 2*a*.

Figure 22:
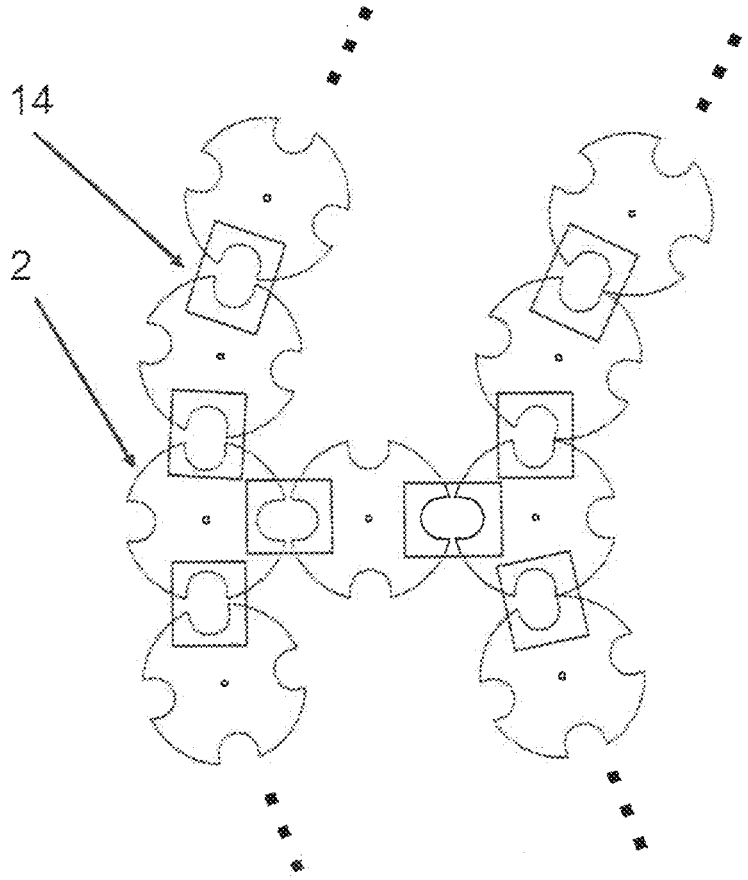
FIG. 22 shows a schematic structure of an enlarged round braiding machine with a plurality of rings, which are connected by an additional impeller.
Figure 23:
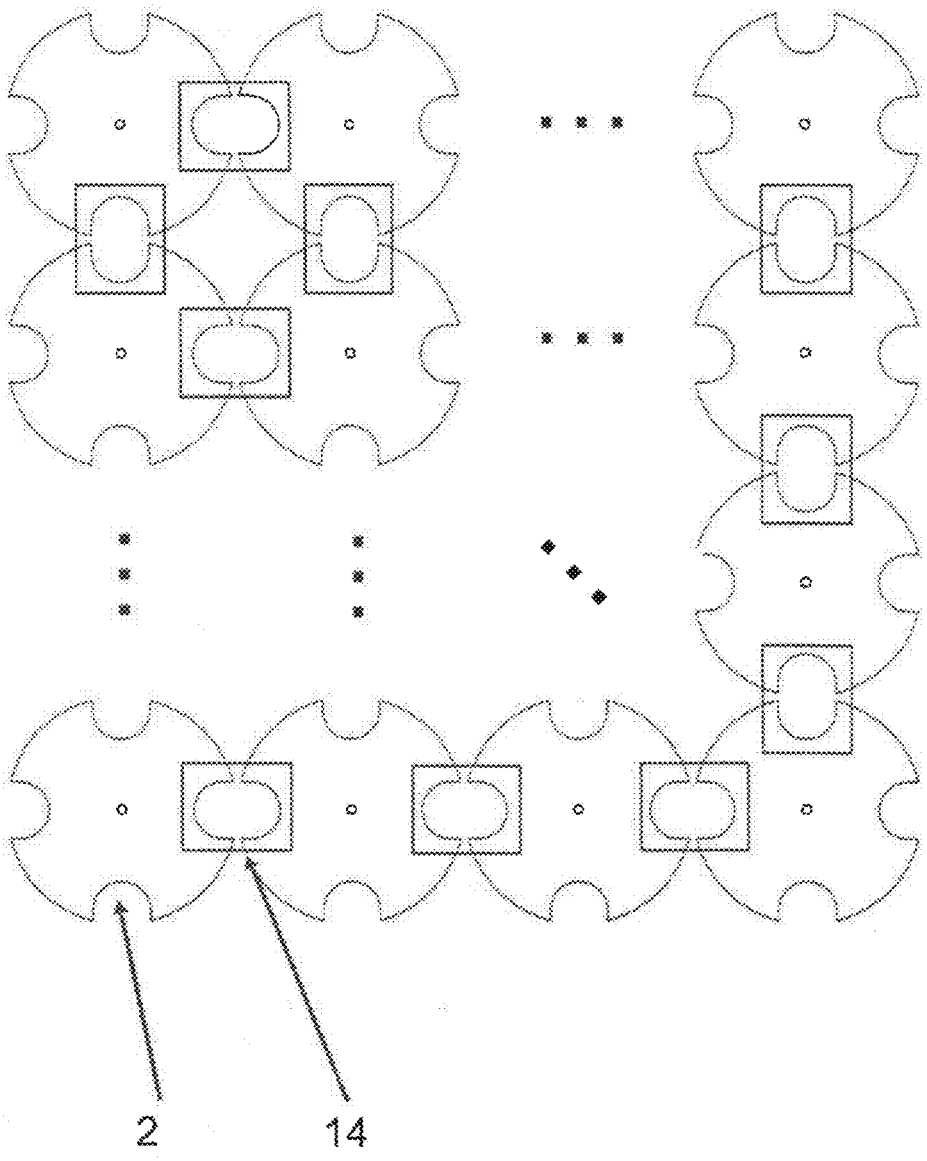
FIG. 23 shows a schematic structure of a square or rectangular braiding machine with any number of impellers arranged in rows and columns.

A further possible embodiment relates to the arrangement of a single impeller 2 between two substantially concentric circles of a plurality of impellers 2, as shown in FIG. 22. In this way, the transfer of a clapper 1 from one of the concentric circles to the other of the concentric circles via the single impeller 2 arranged between the two concentric circles may be carried out. It should be understood that by such an arrangement of a single impeller 2 between concentric circles of impellers 2, further flexibilization of the braiding process is possible.

Figure 24:
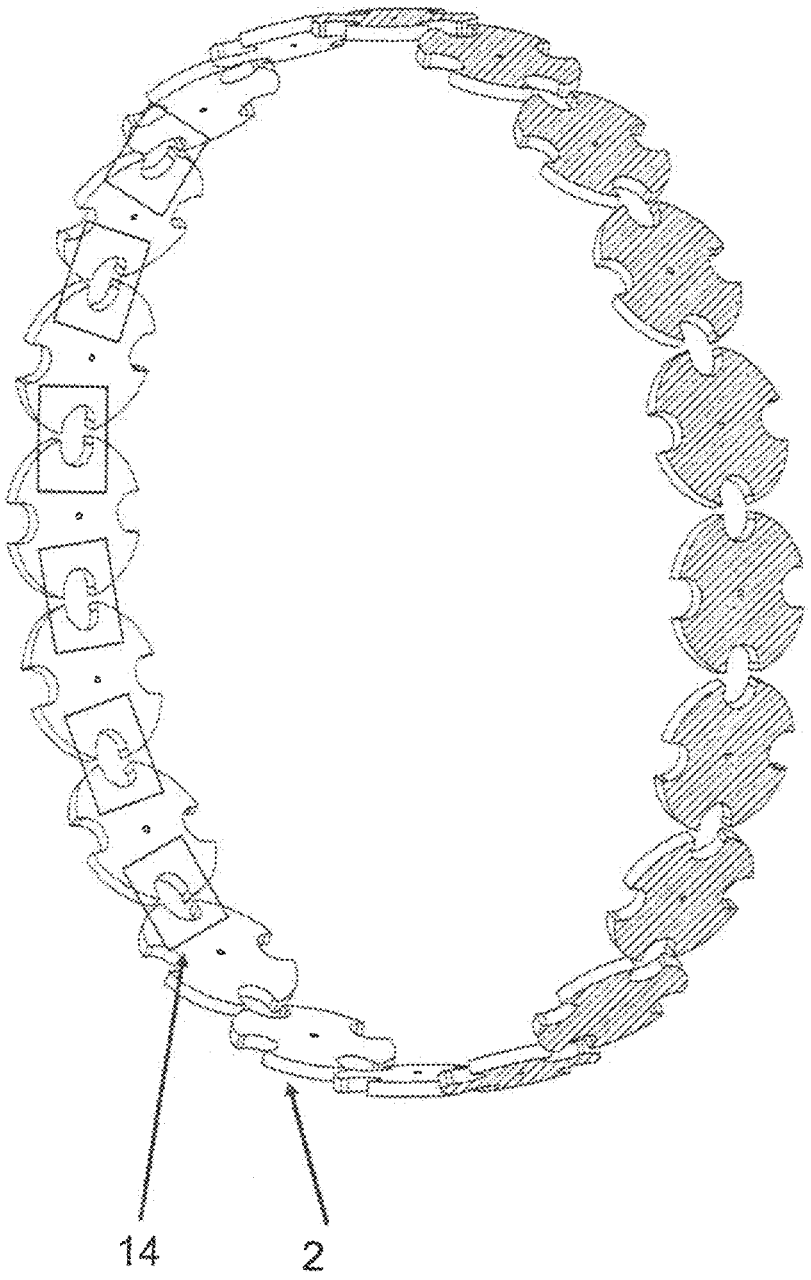
FIG. 24 shows a schematic structure of a round braiding machine in which the impellers are arranged along a circular arc.
Figure 25:
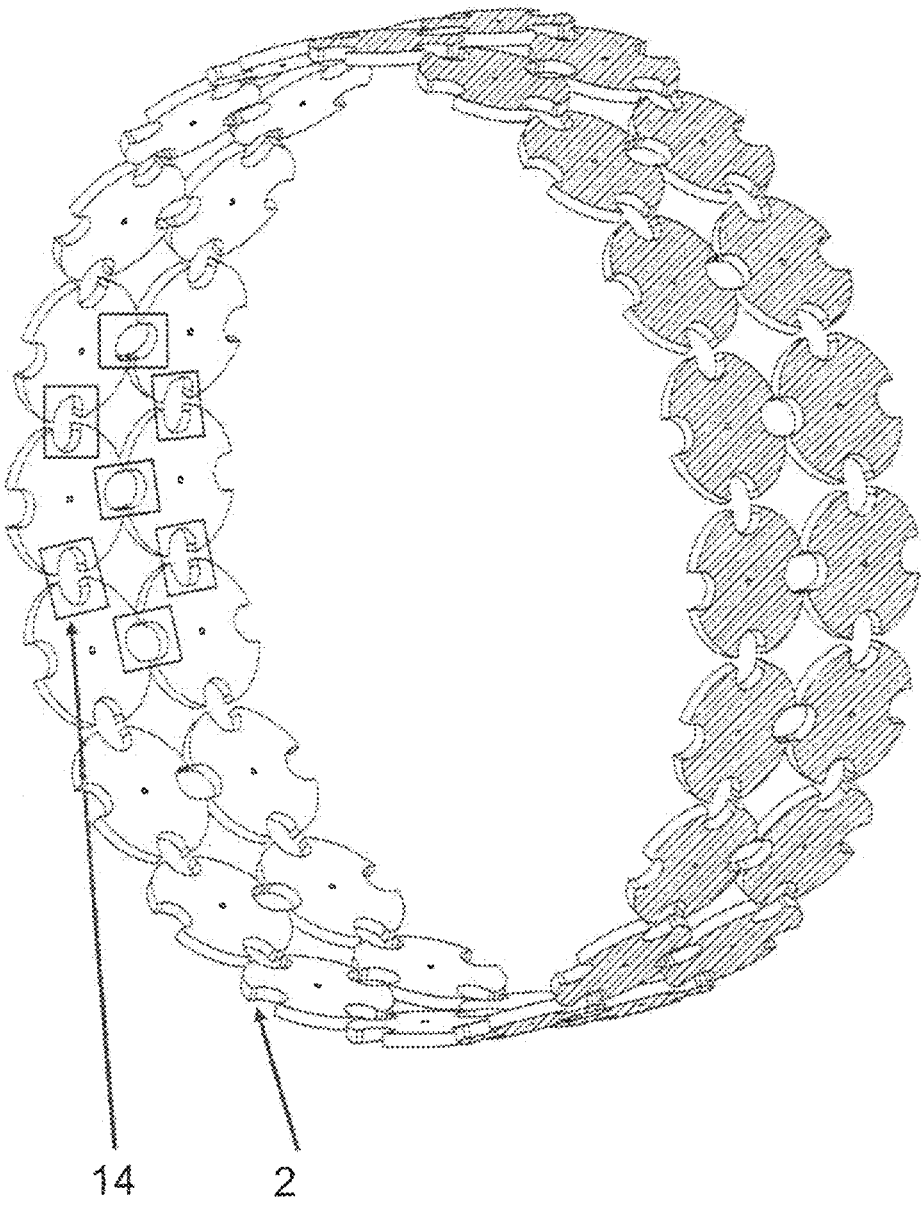
FIG. 25 shows a schematic structure of an enlarged round braiding machine with two rings.

However, the invention is not limited to the arrangement of concentric circles of impellers 2. Rather, the impellers 2 may also be arranged according to a rectangle or a special (i.e. predetermined) pattern or matrix (i.e. arranged in rows and columns in particular), as shown for example in FIG. 23. Furthermore, the plurality of impellers 2 may be arranged with the transfer points 14 arranged there between along the circumference of a cylinder, as shown, for example, in FIG. 24. It should be understood that the plurality of cylindrical circles of impellers 2 shown in FIG. 24 may be arranged side by side. For the sake of simplicity, however, only one cylindrical circle of impellers 2 is shown in FIG. 24. FIG. 25 shows an example of two cylindrical circles of impellers 2. In this case, the cylindrical circles arranged adjacent to one another may each be connected by one or more transfer points 14.

Figure 26:
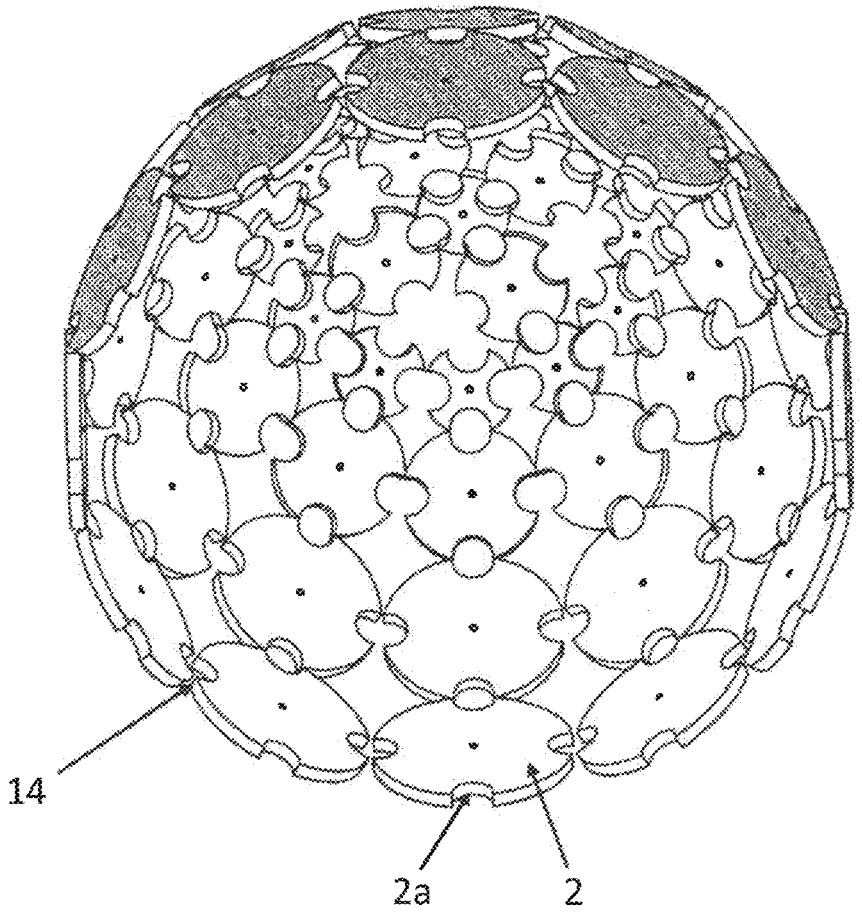
FIG. 26 shows a schematic structure of a spherical hollow sphere braiding machine.

Furthermore, it is possible to arrange the impellers substantially along the surface of a hemisphere, as shown in FIG. 26.

The invention is not limited to an arrangement of impellers 2 according to FIGS. 20 to 26, but any other arrangements of a plurality of impellers 2 may be made within the scope of the invention.

REFERENCE NUMBER LIST

1 clapper
2 impeller

2*a* clapper receiver
3 electromagnet
4 angle
5 electrical conductor
5*a*,5*b* coil or coil section
6 magnetic core
7 magnet housing
7*a*,7*b* leg
8 contact surface or adhesive surface
9 running surface
10 guide element
11 sliding element
12 ferromagnetic material
13 course
14 transfer point
S vertical lines

What is claimed is:

1. A braiding machine with at least two impellers for displacing at least one clapper, wherein the clapper is made at least partially of a ferromagnetic material, and wherein each of the at least two impellers comprises at least one clapper receiver having an electromagnet, wherein the electromagnet encloses a partial circumference of the clapper of 50° to 120° and has the shape of a letter L with two equal legs, wherein a contact surface, with which the clapper comes into contact is formed along both legs.

2. The braiding machine according to claim 1, wherein the electromagnets have two coils or coil sections which are each associated with one of the legs of the L-shape, and/or a contact surface of the clapper receiver has an arc shape to match an outer contour of the clapper.

3. The braiding machine according to claim 1, wherein the electromagnets of the at least two impellers for displacing the at least one clapper are switched off before a transfer point and/or the electromagnets of the impeller, which accept the at least one clapper, are switched on before the transfer point and/or a coils or coil section of the electromagnet or individual electromagnets are supplied with a different voltage and/or current and/or activated/deactivated in a delayed manner.

4. The braiding machine according to claim 3, wherein the electromagnets of the at least two impellers are switched on and off at 20° to 80° before the transfer point.

5. The braiding machine according to claim 1, wherein the at least two impellers are arranged on a flat surface one above the other and side by side in rows and columns or in a circle.

6. The braiding machine according to according to claim 1, wherein the at least two impellers are arranged in concentric circles and each of the concentric circles has the same number of impellers.

7. The braiding machine according to claim 6, wherein at least one additional impeller is arranged in an intermediate space between at least two of the concentric circles.

8. The braiding machine according to claim 1, wherein the at least two impellers are arranged on the circumference of a cylinder, so that all the clappers are directed towards the axis of the cylinder, or the at least two impellers are arranged on the surface of a hemisphere, so that all the clappers are at the same distance to a braiding point located in the center of the hemisphere.

* * * * *